US012359826B2

(12) United States Patent
Mercer

(10) Patent No.: US 12,359,826 B2
(45) Date of Patent: Jul. 15, 2025

(54) AIR HANDLER

(71) Applicant: Rheem Manufacturing Company, Atlanta, GA (US)

(72) Inventor: Kevin Mercer, Danville, IN (US)

(73) Assignee: Rheem Manufacturing Company, Atlanta, GA (US)

( * ) Notice: Subject to any disclaimer, the term of this patent is extended or adjusted under 35 U.S.C. 154(b) by 155 days.

(21) Appl. No.: 18/312,290

(22) Filed: May 4, 2023

(65) Prior Publication Data

US 2023/0358418 A1 Nov. 9, 2023

Related U.S. Application Data

(60) Provisional application No. 63/364,146, filed on May 4, 2022.

(51) Int. Cl.

| | |
|---|---|
| ***F24F 1/0029*** | (2019.01) |
| ***F24F 1/0063*** | (2019.01) |
| ***F24F 13/20*** | (2006.01) |

(52) U.S. Cl.

CPC ..... *F24F 1/0029* (2013.01); *F24F 1/0063* (2019.02); *F24F 13/20* (2013.01); *F24F 2013/205* (2013.01)

(58) Field of Classification Search

CPC ..... F24F 1/0029; F24F 1/0063; F24F 1/0093; F24F 13/20; F24F 2013/205; F24F 2221/54

See application file for complete search history.

(56) References Cited

U.S. PATENT DOCUMENTS

2007/0059167 A1* 3/2007 Hancock ..... F04D 29/4226 415/206
2009/0025418 A1* 1/2009 De La Cruz ..... F28F 9/0202 62/515

* cited by examiner

*Primary Examiner* — Emmanuel E Duke
(74) *Attorney, Agent, or Firm* — Eversheds Sutherland (US) LLP

(57) ABSTRACT

The present disclosure provides an air handler including a body and an axial fan housing disposed within the body. The axial fan housing defines an aperture in fluid communication with an axial fan disposed therein and at least one enclosure located at a corner thereof, such that the at least one enclosure is isolated from a continuous airflow passageway through the aperture of the axial fan housing. The enclosure is configured to house electronic controls therein.

18 Claims, 4 Drawing Sheets

AIR HANDLER

CROSS-REFERENCE TO RELATED APPLICATION

This application claims the benefit of U.S. Application No. 63/364,146, filed May 4, 2022, the entirety of which is hereby incorporated by reference.

TECHNICAL FIELD

The present disclosure relates, in general, to heating, ventilation, and air conditioning (HVAC) systems and, more specifically relates, to an air handler of an HVAC system.

BACKGROUND

In a typical residential HVAC system, a fan in an indoor air handler circulates conditioned air through ducts to various parts of a living space. Any service, diagnosis of an issue of the air handler, or understanding operation of equipment of the air handler typically requires removal of at least one casing panel, thereby exposing the fan, controls, and other electrical components. Removal of the casing panel either renders the air handler inoperable or allows ambient air to enter an airflow passageway from the front of air handler instead of the bottom. Thus, operational characteristics of the air handler may be altered during service or fault diagnosis. Moreover, the controls and other electrical components may be exposed to the airflow passageway, based on an orientation of the air handler.

SUMMARY

According to one aspect of the present disclosure, an air handler is disclosed. The air handler includes a body and an axial fan housing disposed within the body. The axial fan housing defines an aperture in fluid communication with an axial fan disposed therein, and at least one enclosure located at a corner thereof. The at least one enclosure is isolated from a continuous airflow passageway through the aperture of the axial fan housing and configured to house electronic controls.

In an embodiment, the air handler includes an electric heating coil to generate heat. The electric heating coil is disposed within the axial fan housing and proximate the axial fan.

In an embodiment, the air handler includes a fan safety switch to actuate the axial fan.

According to another aspect of the present disclosure, an air handler includes a body and a V-shaped evaporator coil disposed within the body. The air handler also includes an axial fan housing disposed within the body. Specifically, the axial fan housing is located downstream of the V-shaped evaporator coil. The axial fan housing defines an aperture in fluid communication with an axial fan disposed therein, a first enclosure located at a first corner thereof. The first enclosure houses a first set of electronic controls and is isolated from a continuous airflow passageway through the aperture of the axial fan housing.

In an embodiment, the axial fan housing is located vertically above the V-shaped evaporator coil.

In an embodiment, axial fan housing defines a second enclosure located at a second corner thereof. The second enclosure houses a second set of electronic controls and is isolated from the continuous airflow passageway.

In an embodiment, the first enclosure extends between a periphery of the aperture and a periphery of the axial fan housing at the first corner, and the second enclosure extends between the periphery of the aperture and the periphery of the axial fan housing at the second corner.

In an embodiment, the air handler includes one of a first door or a first panel to conceal the first enclosure, and one of a second door or a second panel to conceal the second enclosure. In some embodiments, each of the first door and the second door includes a latch. In some embodiments, each of the first panel and the second panel is fastened to the body.

In some embodiments, each of the first door and the second door includes a latch. In some embodiments, each of the first panel and the second panel is fastened to the body.

In an embodiment, the air handler includes a fan safety switch to actuate the axial fan. In some embodiments, the fan safety switch may be provided for a non-tooled access, such as the latch, of the door. In some embodiments, the fan safety switch may be provided for a tooled access of the door, for example a case where the door is fastened to the body.

According to yet another aspect of the present disclosure, an HVAC system is disclosed. The HVAC system includes an air handler including a body and a V-shaped evaporator coil disposed within the body. The air handler also includes an axial fan housing disposed within the body and vertically above the V-shaped evaporator coil. Specifically, the axial fan housing is located downstream of the V-shaped evaporator coil. The axial fan housing defines an aperture in fluid communication with an axial fan disposed therein, a first enclosure located at a first corner thereof and a second enclosure located at a second corner thereof. The first enclosure houses a first set of electronic controls, and a second enclosure houses a second set of electronic controls. Each of the first enclosure and the second enclosure is isolated from a continuous airflow passageway through the aperture of the axial fan housing. The air handler further includes an electric heating coil to generate heat. The electric heating coil is disposed within the axial fan housing and proximate the axial fan.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Figure 1:
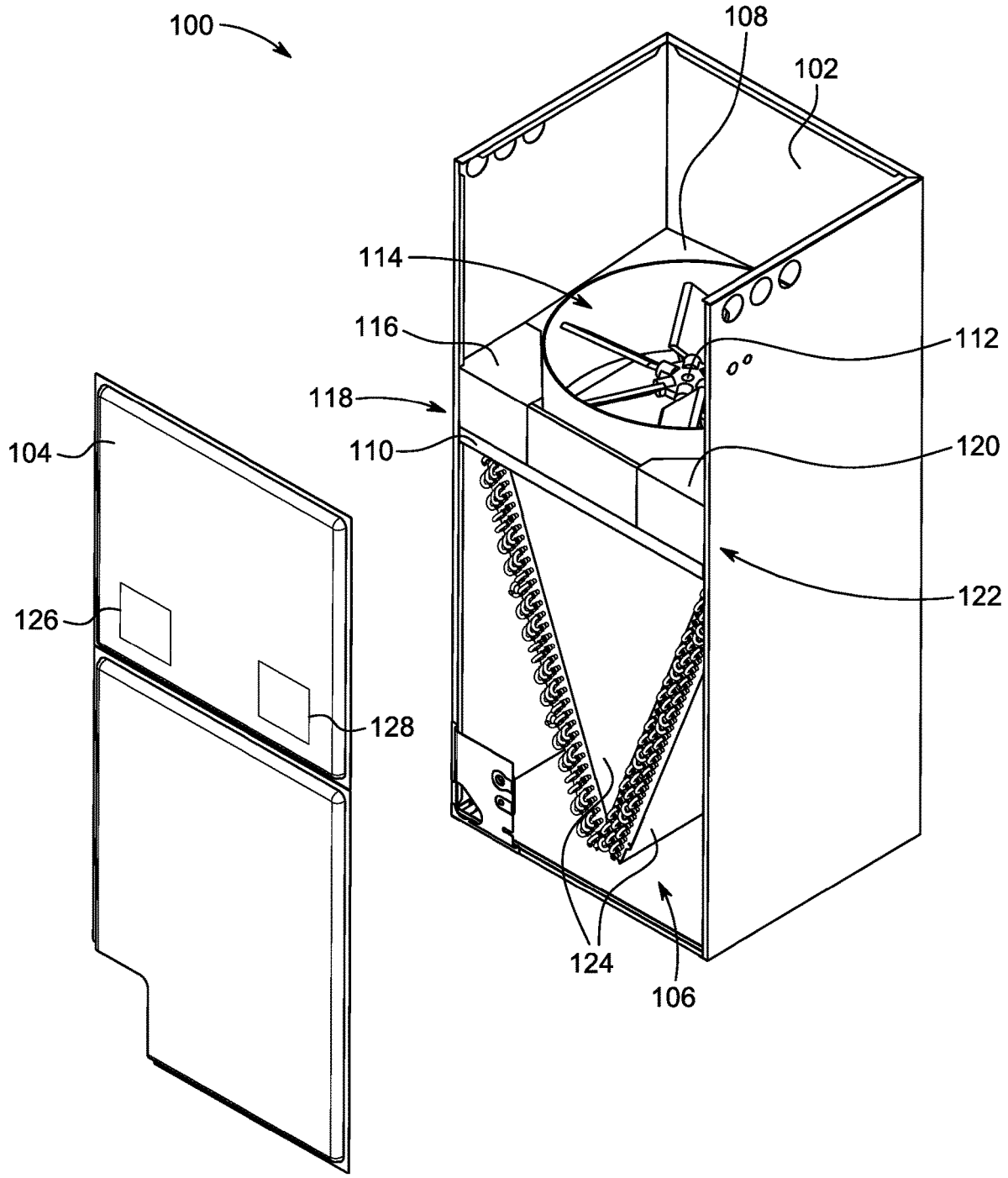
FIG. 1 is a perspective view of an air handler, according to an embodiment of the present disclosure.

Reference will now be made in detail to specific embodiments or features, examples of which are illustrated in the accompanying drawings. Wherever possible, corresponding, or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings. The disclosed technology can be implemented and practiced or carried out in various ways. In particular, the presently disclosed subject matter is described in the context of an air handler of an HVAC system. The present disclosure, however, is not so limited, and can be applicable in other contexts such as air filtration systems, industrial process systems, or other contexts. Accordingly, when the present disclosure is described in the context of an air handler of an HVAC system, it will be understood that other implementations can take the place of those referred to.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

It is also to be understood that the mention of one or more method steps does not preclude the presence of additional method steps or intervening method steps between those steps expressly identified. Moreover, although the term "step" can be used herein to connote different aspects of methods employed, the term should not be interpreted as implying any particular order among or between various steps herein disclosed unless and except when the order of individual steps is explicitly required. Further, the disclosed technology does not necessarily require all steps included in the methods and processes described herein. That is, the disclosed technology includes methods that omit one or more steps expressly discussed with respect to the methods described herein.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

As used herein, the terms "a", "an" and the like generally carry a meaning of "one or more," unless stated otherwise. Further, the terms "approximately", "approximate", "about", and similar terms generally refer to ranges that include the identified value within a margin of 20%, 10%, or preferably 5%, and any values therebetween.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Referring to FIG. 1, a perspective view of an air handler 100 is illustrated. The air handler 100 includes a body 102 that is often referred to as a cabinet. A body cover 104 is shown detached from the body 102 to illustrate few internal components of the air handler 100. A lower portion of the body 102 houses a V-shaped evaporator coil 106 (hereinafter referred to as "the coil 106"). The air handler 100 includes an axial fan housing 108 disposed within the body 102. Particularly, the axial fan housing 108 is disposed vertically above and downstream of the coil 106 with respect to an airflow passage. A support plank 110 fastened to edges of the body 102 is configured to support the axial fan housing 108 within the body 102. The axial fan housing 108 is configured to house an axial fan 112.

Figure 2:
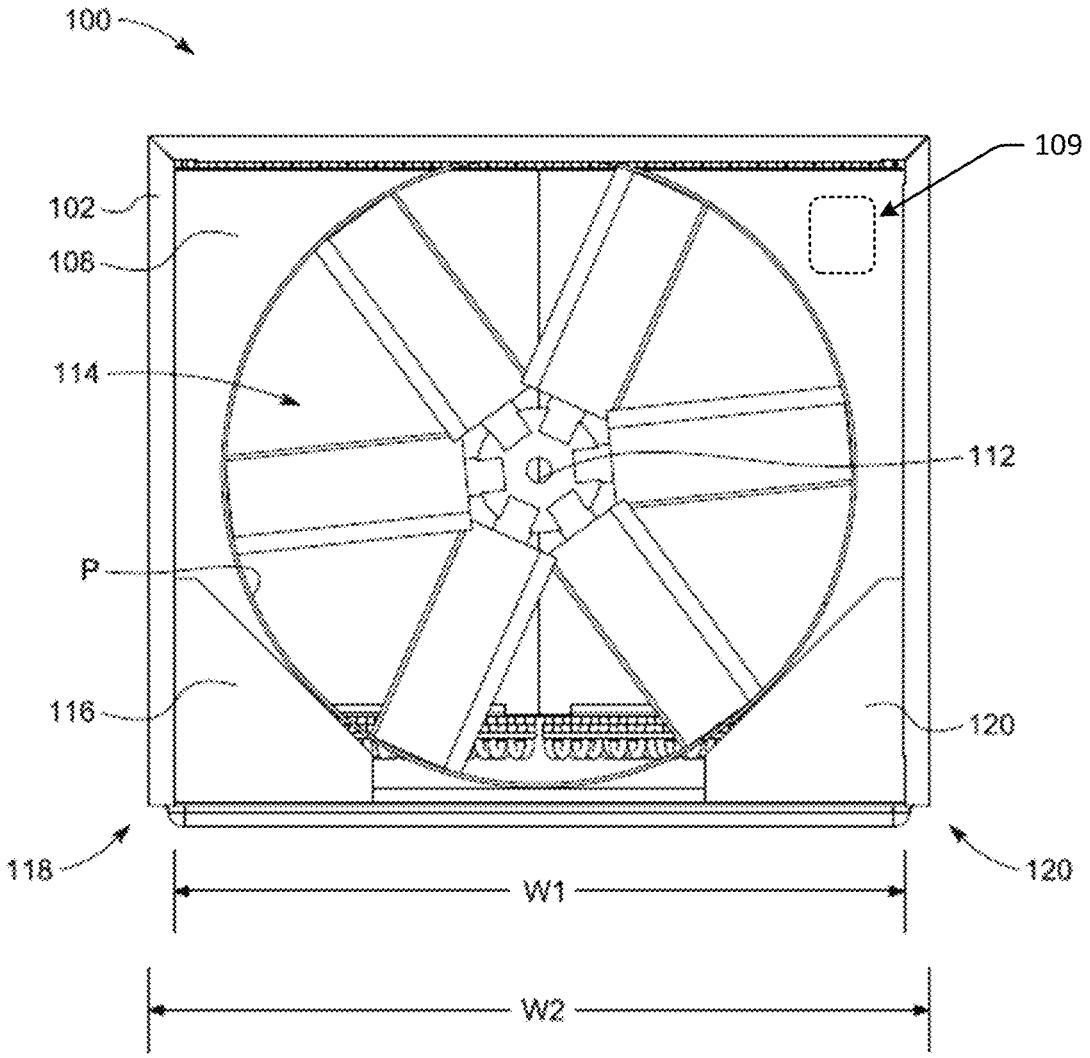
FIG. 2 is a top view of the air handler of FIG. 1, according to an embodiment of the present disclosure.

Further, the axial fan housing 108 defines an aperture 114 in fluid communication with the axial fan 112, and at least one enclosure configured to house electronic controls. In the illustrated embodiment, the air handler 100 includes a first enclosure 116 located at a first corner 118 thereof, and a second enclosure 120 located at a second corner 122 thereof. In an example, each of the first enclosure 116 and the second enclosure 120 may be made be fabricated using galvanized sheet metal. In some embodiments, the air handler 100 may include a single enclosure located at one of the corners. In some embodiments, the air handler 100 may include an electric heating coil 109 (as shown in FIG. 2) disposed within the axial fan housing 108 and proximate the axial fan 112. The electric heating coil 109 is configured to generate heat.

FIG. 2 illustrates a top view of the air handler 100. In dimension, a width "W1" of the axial fan housing 108 is substantially equal to a width "W2" of the body 102, so that the axial fan housing 108 may be, for example, slid into the body 102 over the support plank 110. Additionally, the axial fan housing 108 extends along a complete depth of the body 102. In an assembled position, the aperture 114 defined in the axial fan housing 108 is positioned vertically above the coil 106. Air suctioned by the axial fan 112 flows across the slabs 124 (see FIG. 1) of the coil 106 and further through the aperture 114 in the axial fan housing 108, thereby defining a continuous airflow passageway.

In an embodiment, the first enclosure 116 extends between a periphery "P" of the aperture 114 and a periphery of the axial fan housing 108 at the first corner 118. The periphery of the axial fan housing 108 abuts inner edges of the body 102 and hence is not distinctly visible in FIG. 2. In an example, the axial fan housing 108 may be fastened to the body 102 with one or more fasteners, for example, screws. Similarly, the second enclosure 120 extends between the periphery "P" of the aperture 114 and the periphery of the axial fan housing 108 at the second corner 122. The axial fan 112 creates a straight and continuous airflow passageway in a direction along a height of the air handler 100. In such arrangement, the first corner 118 and the second corner 122 of the axial fan housing 108 do not experience any airflow. As seen in FIG. 2, each of the first enclosure 116 and the second enclosure 120 is isolated from the continuous airflow passageway through the aperture 114 of the axial fan housing 108.

Figure 3:
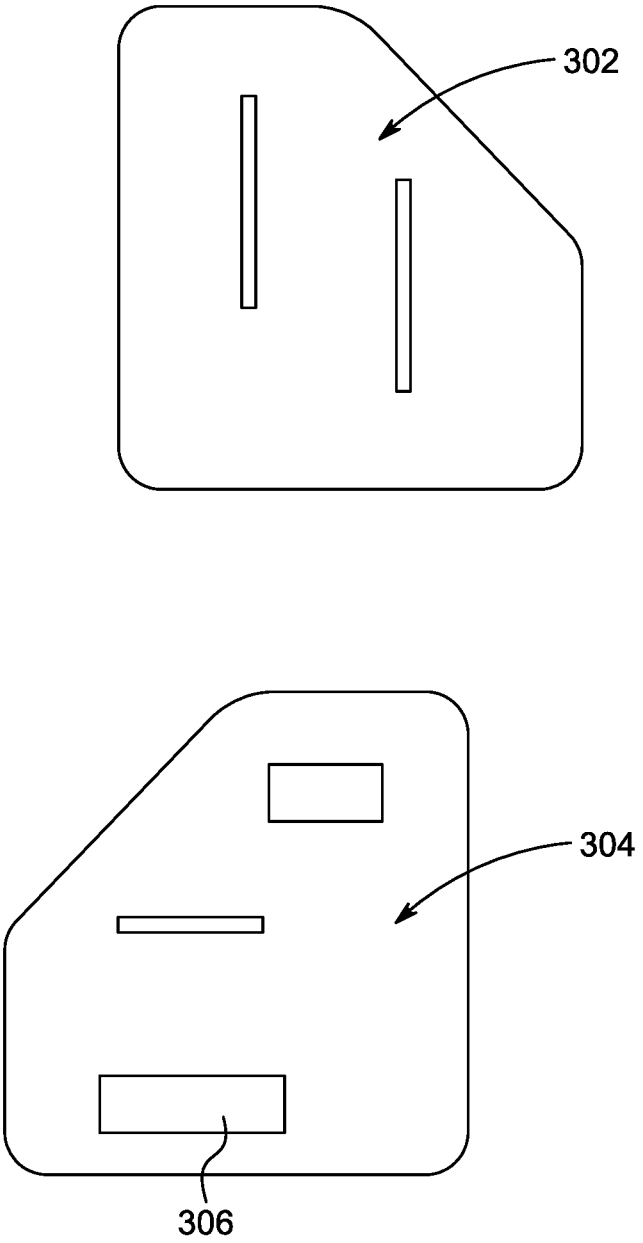
FIG. 3 is an exemplary illustration of components housed in enclosures of the air handler, according to an embodiment of the present disclosure.

FIG. 3 is an exemplary illustration of components housed in each of the first enclosure 116 and the second enclosure 120, according to an embodiment of the present disclosure. The first enclosure 116 is configured to house a first set of electronic controls 302 and the second enclosure 120 is configured to house a second set of electronic controls 304. In an example, the first set of electronic controls 302 and the second set of electronic controls 304 includes, but is not limited to, terminal blocks, printed circuit boards (PCBs), wiring, sensors, microprocessors, disconnects, fuses, and/or other electronic components required to operate and control the air handler 100.

The air handler 100 further includes one of a first door or a first panel (commonly referenced as "126" in FIG. 1) on the body cover 104 corresponding to the location of the first enclosure 116 to conceal the first enclosure 116. The air handler 100 also includes one of a second door or a second panel (commonly referenced as "128" in FIG. 1) on the body cover 104 corresponding to the location of the second enclosure 120 to conceal the second enclosure 120. As such, the first set of electronic controls 302 and the second set of electronic controls 304 can be accessed through the respective doors on the body cover 104, without disturbing the continuous airflow passageway. In some embodiments, components present in each enclosure may be listed on the respective panel 126, 128, so that fault diagnosis and servicing may be performed at required enclosure independently.

In an embodiment, each of the first door 126 and the second door 128 may include a latch (not shown). In another embodiment, each of the first panel 126 and the second panel 128 may be fastened to the body 102. As such, access to the first set of electronic controls 302 and the second set of electronic controls 304 may require a tool to unfasten the respective panel. In some embodiments, the air handler 100 may include a fan safety switch 306 configured to actuate the axial fan 112 or control operation of the axial fan 112. However, such safety switches may be required to comply with safety standards in cases where the air handler 100 does not include tooled access to the enclosures.

Figure 4:
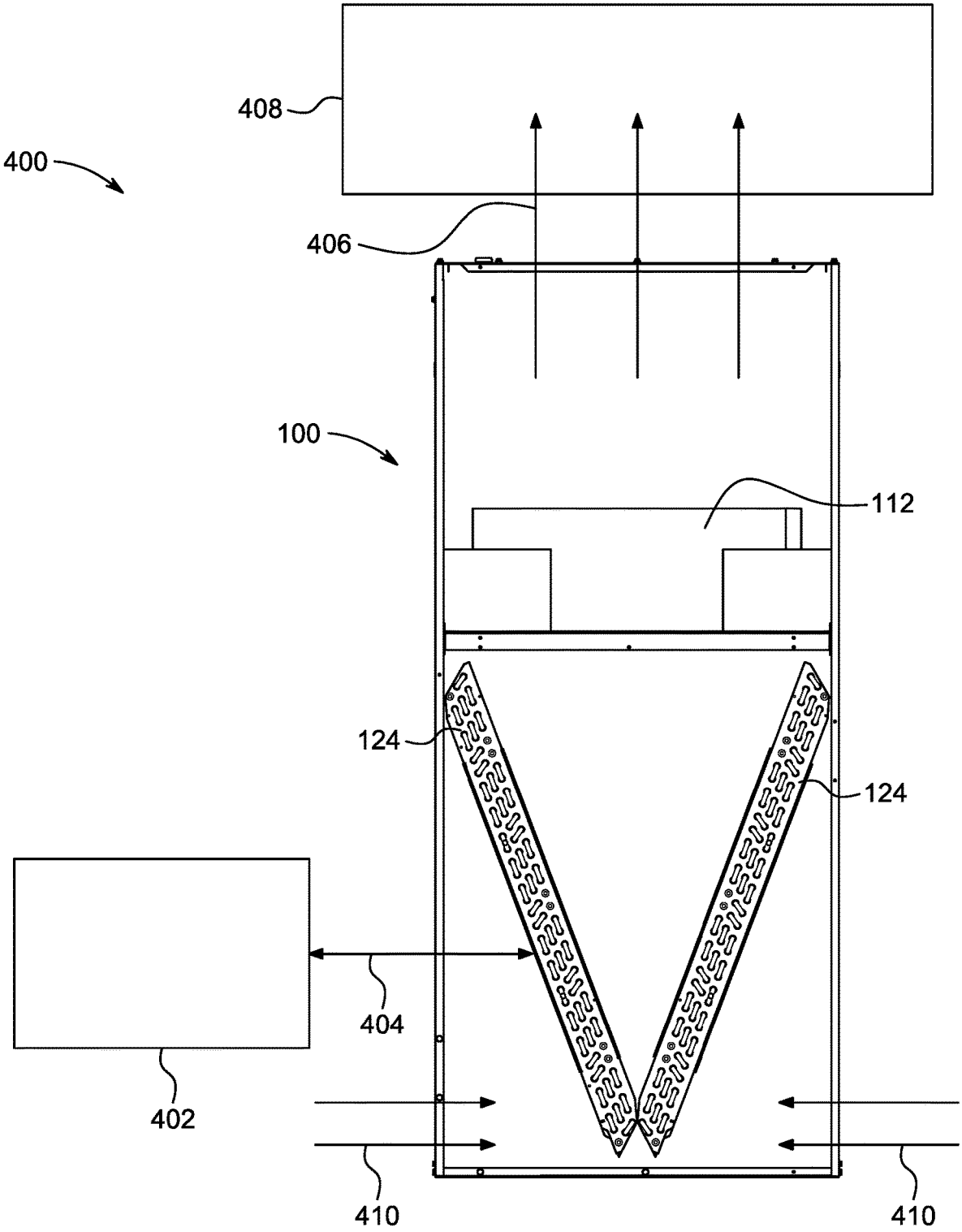
FIG. 4 is an exemplary HVAC system implementing the air handler of FIG. 1, according to an embodiment of the present disclosure.

FIG. 4 illustrates an exemplary HVAC system 400 implementing the air handler 100. The air handler 100 is operatively coupled to an outdoor unit 402 via a conduit 404. In some embodiments, the conduit 404 may be implemented as refrigerant flow circuit extending between the outdoor unit 402 and the coil 106. The HVAC system 400 is configured to supply conditioned air (indicated as "406") into a living space 408. Based on a demand from the living space 408, return air 410 from the living space 408 is circulated towards a base of the coil 106. The axial fan 112 is actuated to suction the return air 410 across the slabs 124 of the coil 106, thereby conditioning the air based on the demand. The conditioned air flows across the axial fan 112 and subsequently reaches the living space 408. The electric heating coil is actuated in cases where the conditioned air flowing across the axial fan 112 needs to be heated.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

What is claimed is:

1. An air handler comprising:
a body; and
an axial fan housing disposed within the body, wherein the axial fan housing defines:
an aperture in fluid communication with an axial fan disposed therein;
at least one enclosure located at a corner thereof, the at least one enclosure configured to house electronic controls, wherein the at least one enclosure is isolated from a continuous airflow passageway through the aperture of the axial fan housing.

2. The air handler of claim 1 further comprising an electric heating coil disposed within the axial fan housing and proximate the axial fan, the electric heating coil configured to generate heat.

3. The air handler of claim 1 further comprising a fan safety switch configured to actuate the axial fan.

4. An air handler comprising:
a body;
a V-shaped evaporator coil disposed within the body; and
an axial fan housing disposed within the body and located downstream of the V-shaped evaporator coil, wherein the axial fan housing defines:
an aperture in fluid communication with an axial fan disposed therein;
a first enclosure located at a first corner thereof, the first enclosure configured to house a first set of electronic controls; and
wherein the first enclosure is isolated from a continuous airflow passageway through the aperture of the axial fan housing.

5. The air handler of claim 4, wherein the axial fan housing is disposed vertically above the V-shaped evaporator coil.

6. The air handler of claim 4, wherein the axial fan housing further defines a second enclosure located at a second corner thereof, the second enclosure configured to house a second set of electronic controls, and wherein the second enclosure is isolated from the continuous airflow passageway.

7. The air handler of claim 6 further comprising:
one of a first door or a first panel configured to conceal the first enclosure; and
one of a second door or a second panel configured to conceal the second enclosure.

8. The air handler of claim 7, wherein each of the first door and the second door comprises a latch.

9. The air handler of claim 7, wherein each of the first panel and the second panel is fastened to the body.

10. The air handler of claim 4 further comprising a fan safety switch configured to actuate the axial fan.

11. The air handler of claim 6, wherein:

the first enclosure extends between a periphery of the aperture and a periphery of the axial fan housing at the first corner, and the second enclosure extends between the periphery of the aperture and the periphery of the axial fan housing at the second corner.

12. A heating, ventilation, and air conditioning (HVAC) system comprising:

an air handler comprising:

a body;

a V-shaped evaporator coil disposed within the body;

an axial fan housing disposed within the body and above the V-shaped evaporator coil, the axial fan housing located downstream of the V-shaped evaporator coil, wherein the axial fan housing defines:

an aperture in fluid communication with an axial fan disposed therein;

a first enclosure located at a first corner thereof, the first enclosure configured to house a first set of electronic controls; and a second enclosure located at a second corner thereof, the second enclosure configured to house a second set of electronic controls, wherein each of the first enclosure and second enclosure is isolated from a continuous airflow passageway through the aperture of the axial fan housing; and an electric heating coil disposed within the axial fan housing and proximate the axial fan, the electric heating coil configured to generate heat.

13. The HVAC system of claim 12, wherein the axial fan housing is disposed vertically above the V-shaped evaporator coil.

14. The HVAC system of claim 12, wherein the air handler further comprises:

one of a first door or a first panel configured to conceal the first enclosure; and one of a second door or a second panel configured to conceal the second enclosure.

15. The HVAC system of claim 14, wherein each of the first door and the second door comprises a latch.

16. The HVAC system of claim 14, wherein each of the first panel and the second panel is fastened to the body.

17. The HVAC system of claim 12, further comprising a fan safety switch configured to actuate the axial fan.

18. The HVAC system of claim 14, wherein:

the first enclosure extends between a periphery of the aperture and a periphery of the axial fan housing at the first corner, and the second enclosure extends between the periphery of the aperture and the periphery of the axial fan housing at the second corner.

* * * * *